US010605570B2

(12) United States Patent
Oh et al.

(10) Patent No.: US 10,605,570 B2
(45) Date of Patent: Mar. 31, 2020

(54) METHOD AND APPARATUS FOR LAUNCH CONTROL PACKET PROCESSING

(71) Applicant: AGENCY FOR DEFENSE DEVELOPMENT, Daejeon (KR)

(72) Inventors: Jino Oh, Daejeon (KR); Joon Ki Min, Daejeon (KR); Jae Yob Lee, Daejeon (KR)

(73) Assignee: AGENCY FOR DEFENSE DEVELOPMENT, Daejeon (KR)

( * ) Notice: Subject to any disclaimer, the term of this patent is extended or adjusted under 35 U.S.C. 154(b) by 0 days.

(21) Appl. No.: 16/163,464

(22) Filed: Oct. 17, 2018

(65) Prior Publication Data

US 2019/0120596 A1 Apr. 25, 2019

(30) Foreign Application Priority Data

Oct. 20, 2017 (KR) ..... 10-2017-0136940

(51) Int. Cl.
*F41G 7/00* (2006.01)

(52) U.S. Cl.
CPC ..... *F41G 7/007* (2013.01); *F41G 7/001* (2013.01)

(58) Field of Classification Search
CPC ..... F41G 7/007; F41G 7/001; F41G 7/006; H04L 69/08; H04L 47/31; F42B 15/01; F41F 3/04
See application file for complete search history.

(56) References Cited

U.S. PATENT DOCUMENTS 8,186,588 B2 * 5/2012 Morocz ..... F41F 3/04 235/400
8,207,480 B2 * 6/2012 Lance ..... F41F 1/00 102/504
2018/0133608 A1 * 5/2018 Young ..... A63H 27/14

OTHER PUBLICATIONS

Oh, J., "The signal processing algorithm of the Missile Flight Test Launch Control System," Journal of the Korea Institute of Information and Communication Engineering, 2015, vol. 19, No. 8, pp. 1965-1972 (with English abstract).

* cited by examiner

*Primary Examiner* — Seung H Lee
(74) *Attorney, Agent, or Firm* — Fenwick & West LLP

(57) ABSTRACT

A launch control system relates to a method and apparatus for launch control packet processing that is provided in the launch control system and configured to allow interworking between a plurality of firing control systems and the launch control system. The launch control system comprises a plurality of operation equipments, a system control device, and control the plurality of operation equipments, a launch control packet processing unit, a control signal distribution device, and a status display device.

12 Claims, 8 Drawing Sheets

FIG. 3A

| Byte No | MESSAGE FIELD | | | | | | | | | | | | | | | | DATA TYPE |
|---|---|---|---|---|---|---|---|---|---|---|---|---|---|---|---|---|---|
| | 15 | 14 | 13 | 12 | 11 | 10 | 9 | 8 | 7 | 6 | 5 | 4 | 3 | 2 | 1 | 0 | |
| 1~2 | MSG ID | | | | | | | | MSG Bete Length | | | | | | | | unsigned short |
| 3~4 | Sequence Number | | | | | | | | MSG ACK/Response<br>ACK Request : 0x00 | | | | | | | | unsigned short |
| 5 | SCC Operation Status No statement : 00<br>Good : 10<br>Degraded : 20<br>Bad : 30 | | | | | | | | | | | | | | | | unsigned char |
| 6 | SCC Operation Status No statement : 00<br>Tactlcal : 10<br>Training : 20<br>Diagmosis : 30<br>Management : 40 | | | | | | | | | | | | | | | | unsigned char |
| 7~8<br>9~10 | Fire Control Status #1 | | | | | | | | | | | | | | | | unsigned short |
| | CountDown Time 1(Second)<br>255.9 ~ 0.0 | | | | | | | | | | | | CDSTing#1<br>None : 0<br>COUNTDOWN : 1 | | | | |
| | FIREENBling#1<br>None : 0<br>LAUNCHABLE : 1 | | | | FIRing#1<br>None : 0<br>LAUNCH : 1 | | | | FIREINHBTing#1<br>None : 0<br>STOP LAUNCHING : 1 | | | | LIFTOFFing#1<br>None : 0<br>BREAKAWAY : 1 | | | | |
| 7~8<br>9~10 | Fire Control Status #2 | | | | | | | | | | | | | | | | unsigned short |
| | CountDown Time 1(Second)<br>255.9 ~ 0.0 | | | | | | | | | | | | CDSTing#1<br>None : 0<br>COUNTDOWN : 1 | | | | |
| | FIREENBling#1<br>None : 0<br>LAUNCHABLE : 1 | | | | FIRing#1<br>None : 0<br>LAUNCH : 1 | | | | FIREINHBTing#1<br>None : 0<br>STOP LAUNCHING : 1 | | | | LIFTOFFing#1<br>None : 0<br>BREAKAWAY : 1 | | | | |
| 15~16 | Padding | | | | | | | | | | | | | | | | ALL 0 |

FIG.3B

| Byte No | MESSAGE FIELD | | | | | | | | | | | | | | | | DATA TYPE |
|---|---|---|---|---|---|---|---|---|---|---|---|---|---|---|---|---|---|
| | 15 | 14 | 13 | 12 | 11 | 10 | 9 | 8 | 7 | 6 | 5 | 4 | 3 | 2 | 1 | 0 | |
| 1~2 | MSG ID | | | | | | | | MSG Bete Length | | | | | | | | unsigned short |
| 3~4 | Sequence Number | | | | | | | | MSG ACK/Response<br>ACK Request : 0x01 | | | | | | | | unsigned short |
| 5 | Firing Sequence #1 Command No statement : 00<br>FIRE ENBL #1 : 10<br>CDST: 20<br>FIRE INHBT #1 :30<br>FIRE : 40<br>LIFT OFF :50 | | | | | | | | | | | | | | | | unsigned char |
| 6 | Firing Sequence #2 Command No statement : 00<br>FIRE ENBL #1 : 10<br>CDST: 20<br>FIRE INHBT #1 :30<br>FIRE : 40<br>LIFT OFF :50 | | | | | | | | | | | | | | | | unsigned char |
| 7~8 | Padding | | | | | | | | | | | | | | | | ALL 0 |

*FIG.3C*

| TYPE | ORDER | OPCODE | COMMAND NAME | Return Opcode |
|---|---|---|---|---|
| FCC to MCC | 1 | h0001 | Fire Enable | h8001 |
| | 2 | h0002 | Count Down | h8002 |
| | 3 | h0003 | Fire | h8003 |
| | 4 | h0004 | Lift Off | h8004 |
| | 5 | h0005 | FCC fire Inhibit | h8005 |
| | 6 | h0006 | Selected MSL Info | h8006 |
| | 7 | h000A | Comm Open | h800A |
| | 8 | h000F | Init | h800F |
| MCC to FCC | 1 | h0011 | #1 MCC Fire Inhibit | h8011 |
| | 2 | h0012 | #2 MCC Fire Inhibit | h8012 |

*FIG. 4*

| PACKET NAME |
| --- |
| MESSAGE FORMAT |
| MESSAGE ID |
| MESSAGE SIZE |
| MESSAGE DEFAULT VALUE |

*FIG. 5*

| TAG=CONDITIONAL EXPRESSION |
| --- |
| OPERATION EXECUTION STATEMENT 1 |
| OPERATION EXECUTION STATEMENT 2 |
| ⋮ |
| OPERATION EXECUTION STATEMENT N |

METHOD AND APPARATUS FOR LAUNCH CONTROL PACKET PROCESSING

CROSS-REFERENCE TO RELATED APPLICATIONS

This application claims priority to Republic of Korea Patent Application No. 2017-0136940 filed on Oct. 20, 2017, the entire contents of which is incorporated herein by reference.

FIELD OF THE INVENTION

The present disclosure relates to a method and apparatus for launch control packet processing. More particularly, the present disclosure relates to a method and apparatus for launch control packet processing that is provided in a launch control system and configured to allow interworking between a plurality of firing control systems and a launch control system.

BACKGROUND OF THE INVENTION

A launch control system controls a guided weapon flight test by executing a launch sequence based on a reference time and a countdown time. The launch control system analyzes guided weapon information received from the firing control system through various communication protocols such as TCP, UDP, and the like. Further, the launch control system controls equipment used for a guided weapon test to perform appropriate operations.

Recently, the purpose for guided weapon tests are becoming more diverse and a variety of new firing control systems are being developed. Since different firing control systems use different protocols and transmit/receive different formats of packets, it is difficult for the launch control system to directly communicate with all of the different firing control systems. Accordingly, a technique for allowing direct communication between a launch control system and a plurality of firing control systems having different communication standards is required.

SUMMARY OF THE INVENTION

In view of the above, the present disclosure provides a technique for enabling communication between a launch control system and a plurality of firing control systems.

The drawbacks to be solved by the present disclosure are not limited to the aforementioned drawbacks, and other drawbacks that are not mentioned will be clearly understood by those skilled in the art.

EFFECT OF THE INVENTION

According to an embodiment of the present disclosure, the launch control system can efficiently transmit and receive the information required to control firing control systems and a guided weapon without a separate interworking module. This is achieved by generating, in advance, packets to be transmitted and received in the case where an interworking start event occurs based on an interface control document (ICD) that includes information on communication protocols of all the firing control systems capable of interworking with the launch control system.

In a conventional case, the launch control system requires an interworking module to interwork with each of the firing control systems. Therefore, when an ICD used for interworking with the firing control systems is partially changed or when a new firing control system is developed, the interworking module that had been used needs to be exchanged. However, according to the embodiment of the present disclosure, even if a new firing control system is developed or an ICD in use is partially changed, the launch control system can directly interwork with the new firing control system, making it possible to reduce the considerable cost and time attributed to developing a separate interworking module.

BRIEF DESCRIPTION OF THE DRAWINGS

The objects and features of the present disclosure will become apparent from the following description of embodiments, given in conjunction with the accompanying drawings, in which:

FIGS. 3A to 3C show examples of interface control documents (ICD) according to an embodiment of the present disclosure;

FIG. 4 is an exemplary view for explaining the formats of a first and second packet generated by a packet generation unit according to an embodiment of the present disclosure;

FIG. 5 is an exemplary view for explaining how a packet processing unit performs operations defined upon a basis of the second and third packet according to an embodiment of the present disclosure.

DETAILED DESCRIPTION OF THE EMBODIMENTS

Figure 1:
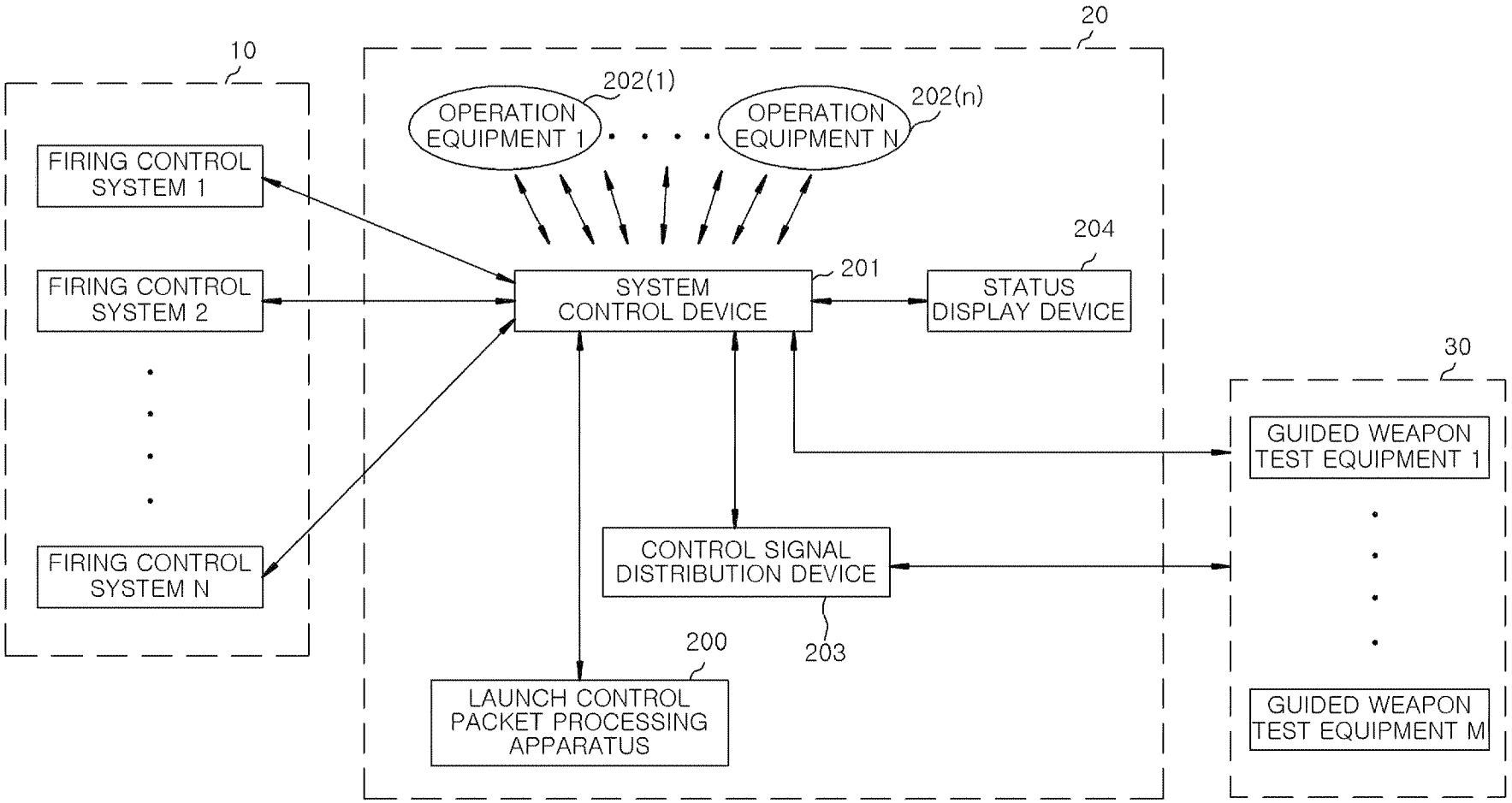
FIG. 1 shows an overall configuration including firing control systems and a launch control system according to an embodiment of the present disclosure.

The advantages and features of embodiments will be clearly understood from the following description taken in conjunction with the accompanying drawings. However, embodiments are not limited to those embodiments described, as embodiments may be implemented in various forms. It should be noted that the present embodiments are provided to make a full disclosure and also to allow those skilled in the art to know the full range of the embodiments. Therefore, the embodiments are to be defined only by the scope of the appended claims.

In describing the embodiments of the present disclosure, if it is determined that detailed description of related known components or functions unnecessarily obscures the gist of the present disclosure, the detailed description thereof will be omitted. Further, the terminologies to be described below are defined in consideration of functions of the embodiments of the present disclosure and may vary depending on a user's or an operator's intention or practice. Accordingly, the definition thereof may be made on a basis of the content throughout the specification.

Functional blocks illustrated in the drawings and described below are merely examples of possible implementations. In other implementations, different functional blocks may be used without departing from the scope of the detailed description. Although one or more functional blocks of the present disclosure are illustrated as separate blocks, one or more of the functional blocks of the present disclosure may be a combination of various hardware and software elements executing the same function.

Further, it should be understood that an expression that some elements are "included" is an expression of an "open type" and the expression simply denotes that the corresponding elements are present, but does not exclude additional elements.

Furthermore, when one element is described as being "connected" or "coupled" to the other element, it should be understood that one element may be directly connected or coupled to the other element, but a third element may be interposed between the two elements.

The terms used herein, including ordinal numbers such as "first" and "second" may be used to describe, and not to limit, various components. The terms simply distinguish the components from one another.

Hereinafter, embodiments of the present disclosure will be described.

FIG. 1 shows an overall configuration including a firing control system 10, a launch control system 20, and a guided weapon test equipment 30 according to an embodiment of the present disclosure.

The firing control system 10 includes devices for controlling a firing sequence of a guided weapon and additional devices used for controlling the devices. The firing control system 10 has a separate communication protocol and firing scenario for controlling the firing of each guided weapon.

The launch control system 20 executes a launch sequence of the guided weapon by transmitting, receiving and analyzing various packets together with the firing control system 10. Further, the launch control system 20 transmits various test control signals to various test equipments used for the guided weapon tests so that the equipment can perform predetermined events used for the guided weapon test. In this manner, the guided weapon flight test is executed and controlled.

Therefore, the launch control system 20 according to an embodiment of the present disclosure may include a packet processing apparatus 200, a system control device 201, operation equipment 202, a control signal distribution device 203, and a status display device 204.

The launch control packet processing apparatus 200 generates, in advance, packets to be transmitted and received in the case where an interworking start event occurs by storing information on different communication standards and guided weapon launching scenarios of the firing control systems. Accordingly, the launch control system 20 can transmit and receive information required to control the firing control system 10 and the guided weapon without a separate interworking module.

The system control device 201 can control the operation equipment 202 built in the launch control system 20, manage the entire launch control system 20, and set signal processing logic for each guided weapon test. Further, the system control device 201 can communicate with the firing control system 10 to transmit/receive information on the guided weapon and also can transmit the packet for controlling the firing sequence of the guided weapon that is generated by the launch control packet processing apparatus 200 to the firing control system 10. The system control device 201 can transmit various commands generated by the launch control packet processing apparatus 200 to the guided weapon test equipment 30 (including test measurement equipment such as a measurement radar, a telemetry system and the like, test control equipment such as a computer system, a status control system and the like) used for the guided weapon flight test. In addition, the system control device 201 collects various information from the guided weapon test equipment and utilizes the collected information to control the test. At this time, the system control device 201 can transmit and receive the information from the guided weapon test equipment based on, but not necessarily limited to, e.g., Ethernet, TTL, serial signal, or the like.

The operation equipment 202 is used to control the launch of the guided weapon and can receive the status information or control the movement of the guided weapon.

The control signal distribution device 203 can be used to interface the signals between the system control device 201 and the guided weapon test equipment 30.

In other words, the control signal distribution device 203 can transmit/receive various test information to/from the launch control system 200 and various guided weapon test equipments 30 (measuring equipment, test control equipment, and the like) used for the guided weapon flight test by, e.g., a method (TTL, serial signal, or the like) other than Ethernet. The control signal distribution device 203 can output a signal (TTL, serial signal, or the like) other than an Ethernet signal through a command from the system control device 201 in response to the result processed by the launch control packet processing apparatus 200. Further, the control signal distribution device 203 can input the signal (TTL, serial signal, or the like) other than an Ethernet signal into the launch control system 20 from an external guided weapon test equipment.

The status display device 204 can display launch control information and predetermined event information.

At this time, the firing control system 10, the launch control system 20, and the guided weapon test equipment 30 can be connected via a wired network or a wireless network.

The launch control packet processing apparatus 200 of the launch control system 20, according to one embodiment of the present disclosure, can integrate functions of interworking modules that are provided in the firing control system 10 to communicate with the launch control system 20 inside the launch control system 20. Accordingly, the launch control packet processing apparatus 200 enables the launch control system 20 to transmit and receive information required to control the guided weapon to and from the firing control system 10 without interworking modules. Hereinafter, the configuration of the launch control packet processing apparatus 200 according to an embodiment of the present disclosure will be described with reference to FIG. 2.

Figure 2:
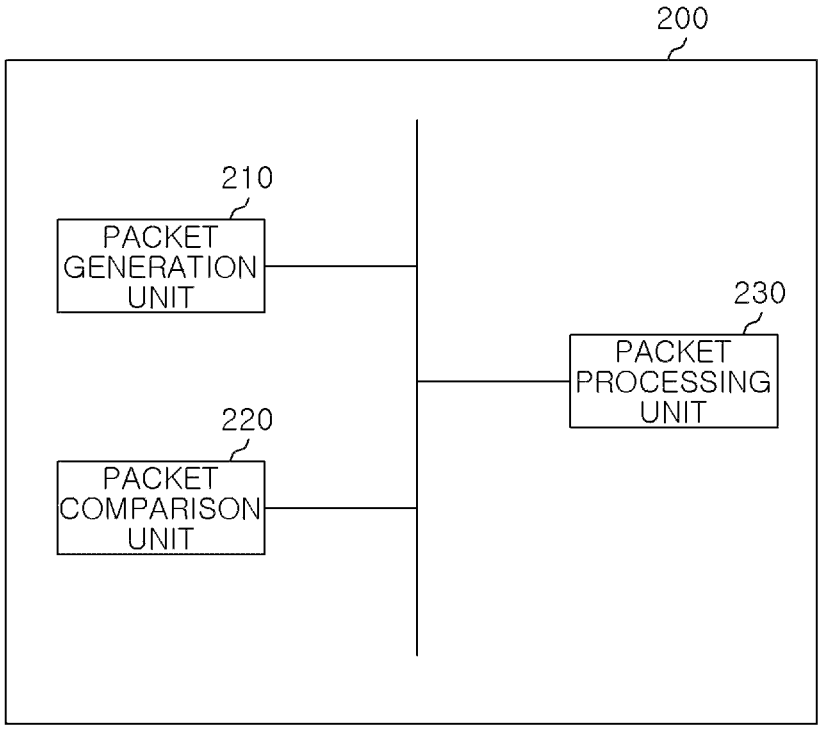
FIG. 2 is a functional block diagram of a launch control packet processing apparatus according to an embodiment of the present disclosure.

FIG. 2 is a functional block diagram of the launch control packet processing apparatus 200 according to an embodiment of the present disclosure.

Referring to FIG. 2, the launch control packet processing apparatus 200 according to an embodiment of the present disclosure includes a packet generation unit 210, a packet comparison unit 220, and a packet processing unit 230.

The packet generation unit 210 generates a packet based on an interface control document (ICD). The ICD defines in advance therein communication protocols used for different test objects and guided weapons for all of the firing control systems 10, format of the packets, information included in the packets, the order of packets to be transmitted/received, operations to be performed in response to a received packet, and the like.

FIGS. 3A to 3C show examples of an ICD according to an embodiment of the present disclosure. FIGS. 3A to 3C show a part of the ICDs used for interworking with different firing control systems. The formats of the packets to be transmitted and received, the order of the packets, the operations to be performed based on the information included in the packets, and the like are defined for each ICD.

At this time, the contents of the ICD can be defined by a user. For example, the packet name, the message format, the message ID, the message size, and the message default value can be created and included as information included in the packet, as well as commands mapped out to control the operations to be performed by the equipment based on the execution statement included in the packet.

When an interworking start event linked to a specific firing control system 10 occurs, the packet generation unit 210 can refer to the ICD and generate a first packet to be transmitted to the corresponding firing control system 10 and a second packet that is expected to be received from the firing control system 10. Accordingly, based on the scenario of the guided weapon test defined in the ICD, the first packet can be transmitted to the interworking firing control system 10 or the operation equipment 202 included in the interworking launch control system 20. The second packet can be used for comparison to see if the third packet received from the interworking launch control system 20 was properly generated based on the definition in the ICD.

FIG. 4 is an exemplary view for explaining the formats of the first and second packets generated by the packet generation unit 210 according to an embodiment of the present disclosure.

As shown in FIG. 4, the packet generation unit 210 can generate a packet based on the information stored in the ICD created by the user, as shown in FIG. 3, that includes information on the packet name, message format, message ID, message size, and message default value. However, the format shown in FIG. 4 is merely an example to help better understand the present disclosure, and the format is not limited thereto.

The packet comparison unit 220 compares the third packet received from the firing control system 10 with the second packet generated by the packet generation unit 210 and determines whether or not they match. At this time, the packet comparison unit 220 can determine whether or not the data included in the second packet matches the data included in the third packet in their entirety, or determine whether or not the second packet matches the third packet by comparing only the information included in a particular data space among various data spaces included in the packet.

FIG. 5 is an exemplary view for explaining the operations defined upon a basis of the second and third packet and performed by the packet processing unit 230 according to an embodiment of the present disclosure.

Referring to FIG. 5, when there is a second packet matched with the third packet received from the firing control system 10 among the second packets generated by the packet generation unit 210 (Tag=conditional expression), the packet processing unit 230 can allow the launch control system 20 to perform the operation execution statement defined in the ICD according to the contents included in the third packet or the second packet matched with the third packet.

For example, when there is a second packet matched with the third packet received from the firing control system 10 among the second packets generated by the packet generation unit 210, the packet processing unit 230 can analyze the information included in the second packet matched with the third packet or the information included in the third packet and transmit to the firing control system 10 the first packet that is defined in the ICD as a packet to be transmitted after the reception of the third packet. At this time, the first packet may include information on the operation to be executed by the firing control system 10.

Further, when there is a second packet matched with the third packet received from the firing control system 10 among the second packets generated by the packet generation unit 210, the packet processing unit 230 can analyze the information included in the second packet matched with the third packet or the information included in the third packet and operate the operation equipment built in the launch control system based on the contents defined in the ICD. For example, the first packet that is defined in the ICD as a packet to be transmitted after the reception of the third packet can be transmitted to the operation equipment 202 of the launch control system 20. At this time, the first packet may contain information on the operation to be executed by the operation equipment 202.

On the contrary, when there is no second packet matched with the third packet received from the firing control system 10 among the second packets generated by the packet generation unit 210, the packet processing unit 230 can transmit a packet re-transmission request message to the firing control system 10 based on transmitting the packet re-transmission request message to the launch control system 20 and output an error message to a user.

The packet generation unit 210, the packet comparison unit 220, and the packet processing unit 230 of the above-described embodiment can be implemented by an operation device including a memory having commands programmed to execute the functions thereof, and a microprocessor for executing the commands.

Figure 6A:
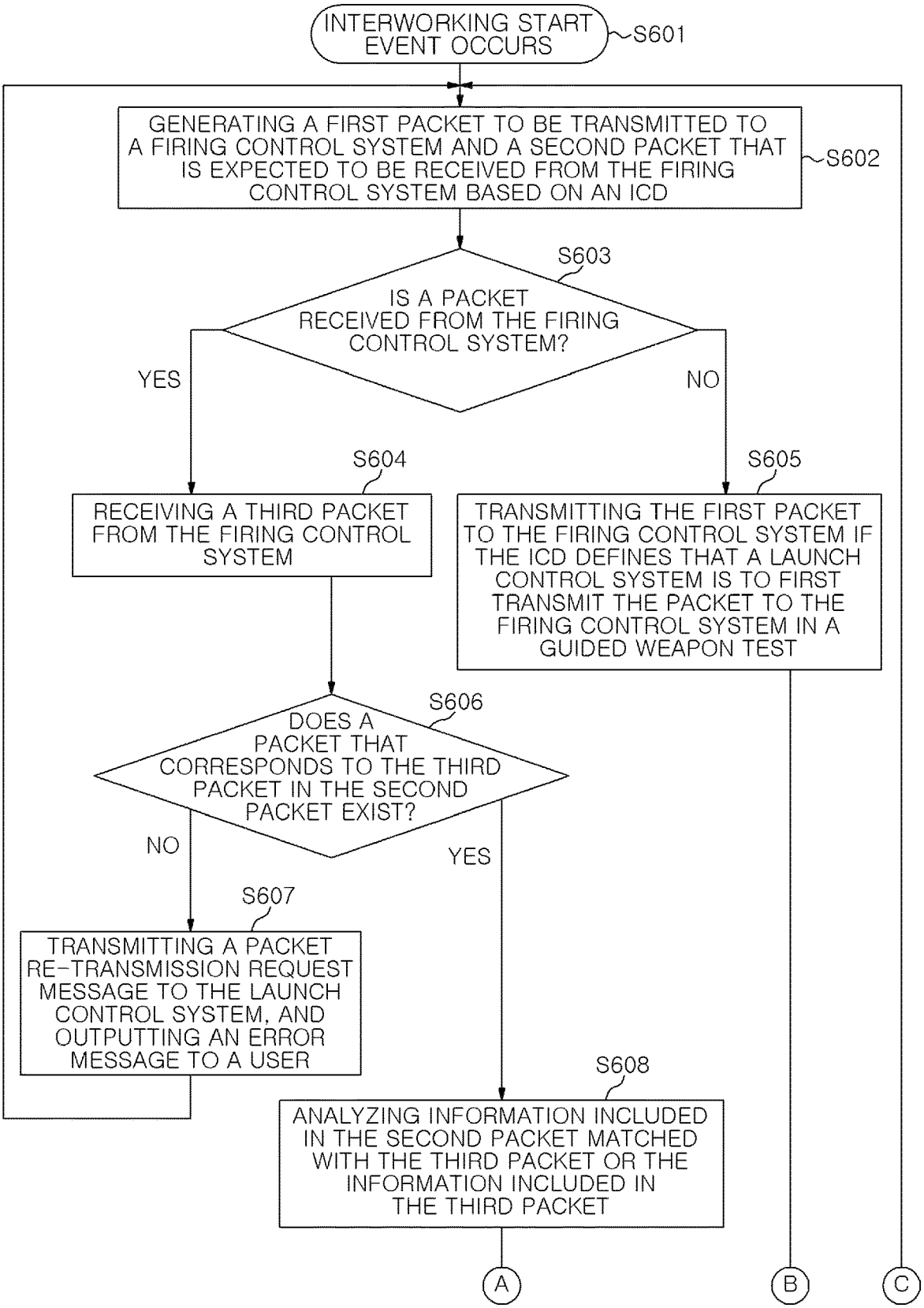
FIGS. 6A and 6B are a flowchart showing the processes of a launch control packet processing method according to an embodiment of the present disclosure.
Figure 6B:
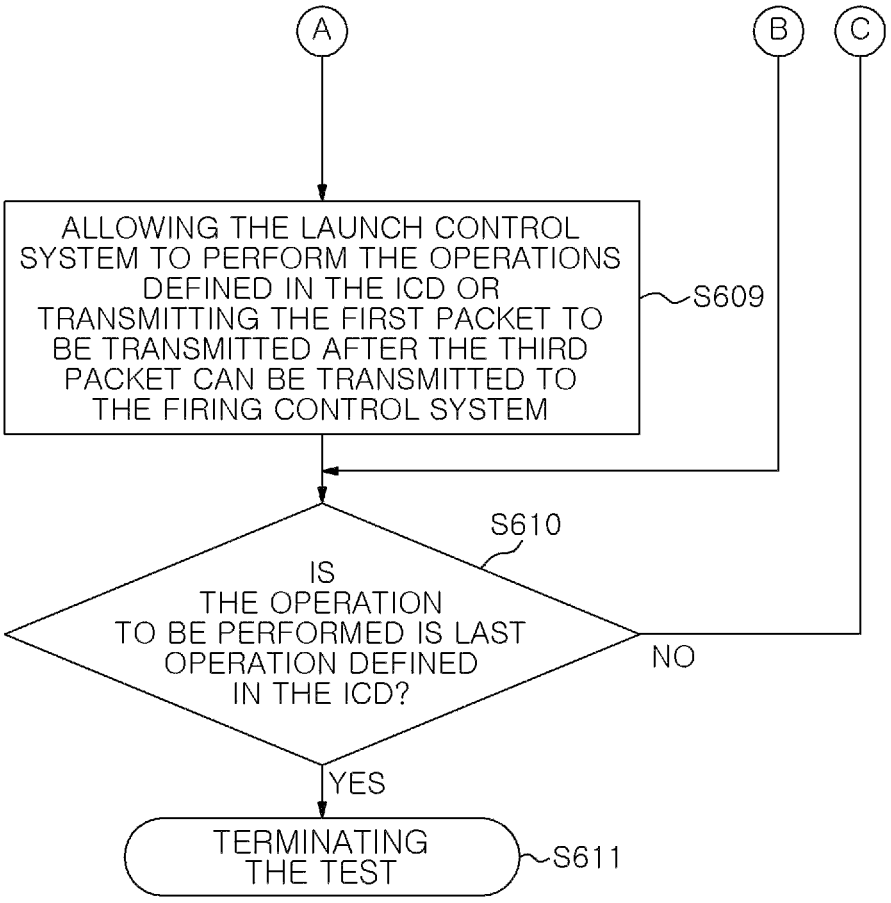

FIGS. 6A and 6B are a flowchart showing the processes of a launch control packet processing method according to an embodiment of the present disclosure. Each step of the launch control packet processing method shown in FIGS. 6A and 6B can be performed by the launch control packet processing apparatus 200 described with reference to FIGS. 6A and 6B. The following is a description of each step.

First, when an interworking start event linked with a predetermined firing control system 10 occurs (S601), the packet generation unit 210 generates a first packet to be transmitted to the firing control system 10 and a second packet that is expected to be received from the firing control system 10 based on an ICD in which formats of packets to be transmitted to and received from the firing control system 10 and the order of the packets to be transmitted to and received from the firing control system 10 are defined in advance (S602). Accordingly, when the launch control system 20 first starts to transmit the packet to the firing control system 10, the packet processing unit 230 can transmit the first packet to the firing control system 10 if the ICD defines that the launch control system 20 does not receive from the firing control system 10 (S603) and the launch control system 20 is to first transmit the packet to the firing control system 10 in the guided weapon test (S605).

The launch control system 20 can receive the third packet from the firing control system 10 (S604). Then, the packet comparison unit 220 compares the third packet received from the firing control system 10 and the second packet generated by the packet generation unit 210 (S606).

At this time, if there is a second packet matched with the third packet received from the firing control system 10 among the second packets generated by the packet generation unit 210, the packet processing unit 230 can analyze the information included in the second packet matched with the third packet or the information included in the third packet (S608). Further, the packet processing unit 230 can allow the launch control system to perform the operations defined in the ICD based on the analyzed information. For example, the first packet for controlling the operation equipment 202 included in the launch control system 20 can be transferred to the operation equipment 202 (S609), or the first packet to be transmitted after the third packet can be transmitted to the firing control system 10 (S609). At this time, the packet processing unit 230 determines whether or not the operation to be performed is the last operation defined in the ICD (S610). If it is the last operation, the test is terminated (S611). If it is not the last operation, the packet processing unit 230 can wait for a third packet to be received from the firing control system 10 or transmit the first packet to the firing control system 10.

On the other hand, if there is no second packet matched with the third packet received from the firing control system 10 among the second packets generated by the packet generation unit 210, the packet processing unit 230 can transmit a packet re-transmission request message to the firing control system 10 based on transmitting the packet re-transmission request message to the launch control system 20 and output an error message to a user S607).

According to the above-described embodiment, the launch control system 20 can efficiently transmit and receive the information required to control the firing control system 10 and the guided weapon without a separate interworking module. This is achieved by generating, in advance, packets to be transmitted and received in the case where an interworking start event occurs based on an ICD that includes information on the communication protocols of all the firing control systems 10 capable of interworking with the launch control system 20.

In a conventional case, the launch control system requires an interworking module to interwork with each of the firing control systems. Therefore, when an ICD used for interworking with the firing control system is partially changed or when a new firing control system is developed, the interworking module that had been used needs to be exchanged. However, according to the embodiment of the present disclosure, even if a new firing control system 10 is developed or an ICD in use is partially changed, the launch control system 20 can directly interwork with the new firing control system 10 by the method described with reference to FIGS. 4 and 5, making it possible to reduce the considerable cost and time attributed to developing a separate interworking module.

The above-described embodiments of the present disclosure can be implemented by various devices. For example, the embodiments of the present disclosure can be implemented by hardware, firmware, software, combinations thereof, or the like.

In the case of implementation using hardware, the method according to the embodiments of the present disclosure may be implemented by one or more devices, such as ASICs (Application Specific Integrated Circuits), DSPs (Digital Signal Processors), DSPDs (Digital Signal Processing Devices), PLDs (Programmable Logic Devices), FPGAs (Field Programmable Gate Arrays), processors, controllers, microcontrollers, microprocessors or the like.

In the case of implementation using firmware or software, the method according to the embodiments of the present disclosure may be implemented in the form of modules, procedures or functions for performing the above-described functions or operations. A computer program in which a software code or the like is recorded may be stored in a computer-readable storage medium or a memory unit and executed by a processor. The memory unit may be provided inside or outside the processor to exchange data with the processor by various known units.

Combinations of blocks in the flowcharts of the present disclosure can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions specified in the steps of the flowchart. These computer program instructions may also be stored in a computer usable or computer readable memory that can direct a computer or other programmable data processing apparatuses to function in a particular manner, such that the instructions stored in the computer usable or computer readable medium can produce an article of manufacture including instructions that implement the function specified in the blocks of the flowcharts. The computer program instructions may also be loaded onto a computer or other programmable data processing apparatuses to cause a series of operational steps to be performed on the computer or other programmable apparatuses to produce a computer implemented process such that the instructions that are executed on the computer or other programmable apparatuses provide processes for implementing the functions specified in the blocks of the flowcharts.

Each block in the flowchart may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved.

As described above, those skilled in the art will understand that the present disclosure can be implemented in other forms without changing the technical idea or essential features thereof. Therefore, it should be understood that the above-described embodiments are merely examples, and are not intended to limit the present disclosure. The scope of the present disclosure is defined by the accompanying claims rather than the detailed description, and the meaning and scope of the claims and all changes and modifications derived from the equivalents thereof should be interpreted as being included in the scope of the present disclosure.

What is claimed is:

1. A launch control system comprising:

a plurality of operation equipments used for launch control of a guided weapon;

a system control device configured to communicate with a plurality of firing control systems for controlling a firing sequence of the guided weapon and a plurality of test equipments, and control the plurality of operation equipments;

a launch control packet processing unit configured to generate, when an interworking start event linked to one of the plurality of firing control systems begins, one or more first packets to be transmitted to said one of the firing control systems and one or more second packets that are expected to be received from said one of the firing control systems based on an interface control document (ICD), and configured to analyze, when a third packet received by the system control device and said one or more second packets are compared and the third packet is determined to match at least one of said one or more second packets, information included in the third packet to allow the system control device to transmit said one or more first packets to the firing control systems based on the information, or allow the system control device to control the operation equipments based on the information;

a control signal distribution device configured to interface signals between the system control device and the test equipments; and a status display device configured to display launch control information of the system control device and event information.

2. A launch control packet processing apparatus built in in a launch control system, comprising:

a packet generation unit configured to generate, when an interworking start event linked to a predetermined firing control system occurs, one or more first packets to be transmitted to the firing control system and one or more second packets that are expected to be received from the firing control system based on an interface control document (ICD) in which formats of packets to be transmitted to and received from the firing control system and an order of the packets to be transmitted to and received from the firing control system are previously defined;

a packet comparison unit configured to compare a third packet received from the firing control system and said one or more second packets; and a packet processing unit configured to analyze, when the third packet is determined to match at least one of said one or more second packets, information included in the third packet and, based on the information, allow the launch control system to perform operations defined in the ICD.

3. The launch control packet processing apparatus of claim 2, wherein the packet processing unit analyzes, when the third packet is determined to match at least one of said one or more second packets, information included in the third packet and transmits a packet that is defined in the ICD as a packet to be transmitted after the third packet is received among said one or more first packets to the launch control system.

4. The launch control packet processing apparatus of claim 2, wherein the packet processing unit analyzes, when the third packet is determined to match at least one of said one or more second packets, information included in the third packet and operates operation equipments built in the launch control system based on contents defined in the ICD.

5. The launch control packet processing apparatus of claim 2, wherein the packet processing unit transmits a packet re-transmission request message to the launch control system when there is no packet matched with the third packet among said one or more second packets.

6. The launch control packet processing apparatus of claim 2, wherein the packet processing unit outputs an error message when there is no packet matched with the third packet among said one or more second packets.

7. A launch control packet processing method performed by one or more processors, comprising:

generating, when an interworking start event linked to a predetermined firing control system occurs, one or more first packets to be transmitted to the firing control system and one or more second packets that are expected to be received from the firing control system based on an interface control document (ICD) in which formats of packets to be transmitted to and received from the firing control system and orders of the packets to be transmitted to and received from the firing control system are defined in advance;

comparing a third packet received from the firing control system with said one or more second packets; and analyzing, when the third packet is determined to match at least one of said one or more second packets, information included in the third packet and, based on the information, allowing the launch control system to perform operations defined in the ICD.

8. The launch control packet processing method of claim 7, wherein the allowing the launch control system to perform operations defined in the ICD includes:

analyzing, when the third packet is determined to match at least one of said one or more second packets, information included in the third packet and transmitting to the firing control system a packet that is defined in the ICD as a packet to be transmitted after the third packet is received among said one or more first packets.

9. The launch control packet processing method of claim 7, wherein the allowing the launch control system to perform operations defined in the ICD includes:

analyzing, when the third packet is determined to match at least one of said one or more second packets, information included in the third packet and allowing operation equipments built in the launch control system to operate based on contents defined in the ICD.

10. The launch control packet processing method of claim 7, wherein the allowing the launch control system to perform operations defined in the ICD includes:

transmitting a packet re-transmission request message to the launch control system when there is no packet matched with the third packet among said one or more second packets.

11. The launch control packet processing method of claim 7, wherein the allowing the launch control system to perform operations defined in the ICD includes:

outputting an error message when there is no packet matched with the third packet among said one or more second packets.

12. A non-transitory computer-readable recording medium storing instructions thereon, the instructions when executed by a processor causing the processor to:

generate, when an interworking start event linked to a predetermined firing control system occurs, one or more first packets to be transmitted to the firing control system and one or more second packets that are expected to be received from the firing control system based on an interface control document (ICD) in which formats of packets to be transmitted to and received from the firing control system and orders of the packets to be transmitted to and received from the firing control system are defined in advance;

comparing a third packet received from the firing control system with said one or more second packets; and analyze, when the third packet is determined to match at least one of said one or more second packets, information included in the third packet and, based on the information, allowing a launch control system to perform operations defined in the ICD.

* * * * *